United States Patent [19]

Walden

[11] Patent Number: 4,951,942

[45] Date of Patent: Aug. 28, 1990

[54] MULTIPLE PURPOSE EXERCISE DEVICE

[76] Inventor: Jerold A. Walden, 172 H Brandywine Dr., Westerville, Ohio 43081

[21] Appl. No.: 355,756

[22] Filed: May 22, 1989

[51] Int. Cl.[5] ..... A63B 21/02

[52] U.S. Cl. ..... 272/135; 272/93; 272/97; 272/69; 272/72; 272/154

[58] Field of Search ..... 272/93, 97, 69, 70, 272/70.3, 72, 116, 126, 127, 128, 131, 138, 133–136, 142, DIG. 4; 128/25 R, 25 B

[56] References Cited

U.S. PATENT DOCUMENTS

| | | | |
|---|---|---|---|
| 2,855,200 | 10/1958 | Blickman | 272/134 |
| 2,921,790 | 1/1960 | Nawara | 272/134 |
| 3,636,946 | 1/1972 | Hardy | 272/138 |
| 3,677,543 | 7/1972 | Richardson | 272/136 |
| 3,792,860 | 2/1974 | Selmes | 272/70 X |
| 3,912,260 | 10/1975 | Rice | 272/97 |
| 4,023,795 | 5/1977 | Pauls | 272/97 |
| 4,059,265 | 11/1977 | Wieder | 272/137 |
| 4,072,309 | 2/1978 | Wilson | 272/142 |
| 4,371,162 | 1/1983 | Hartzell | 272/138 |
| 4,496,147 | 1/1985 | DeCloux et al. | 272/70 X |
| 4,512,571 | 4/1985 | Hermelin | 272/134 X |
| 4,540,172 | 9/1985 | Evans | 272/133 X |
| 4,541,627 | 9/1985 | Mac Lean | 272/72 |
| 4,541,628 | 9/1985 | Parviainen | 272/117 |
| 4,634,119 | 1/1987 | Pesthy | 272/136 X |
| 4,709,918 | 12/1987 | Grinblat | 272/70 X |
| 4,813,667 | 3/1989 | Watterson | 272/134 X |

*Primary Examiner*—Richard J. Apley
*Assistant Examiner*—Joe H. Cheng

[57] ABSTRACT

A multiple purpose exercise device has a base unit (19) and a telescopic lever arm (15, 16) which supports and holds various widths and lengths of elastic biasing cord (18). Contained within the base unit is a lock fastening device (20) which secures the elastic biasing cord in place to prevent movement when stretching the cord during exercise. The base unit and telescopic lever arm can be attached to a collapsible framework (21, 22, 23, 24) for a wider variety of anaerobic type exercises. The framework consists of four rectangular formed sections (21A, 22A) connected by two rotatable locking hinges (22E, 21H, 25) and supported by three collapsible rectangular shaped stabilizer members (23A, 23E, 23B, 24A, 24B). In conjunction with the framework, the base unit, the telescopic lever arm and the biasing cord, a pair of rectangular length rails (26) each supporting a free rolling gliding unit (27) can be employed for aerobic type exercises. The gliding units support either a pair of foot pedals (29) or a seat pad (28) for simulating either a cross country skiing or a rowing motion, respectively. The complete exercise unit can be used to perform a wide variety of anaerobic as well as aerobic exercises depending on which attachment is being employed.

19 Claims, 5 Drawing Sheets

FIG 1A
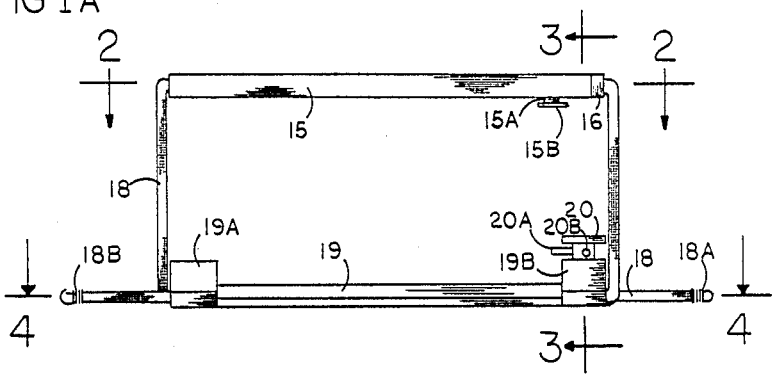
FIG 1B
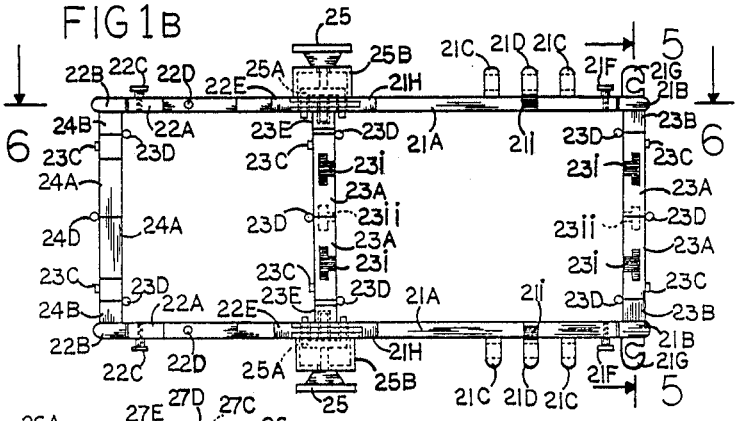
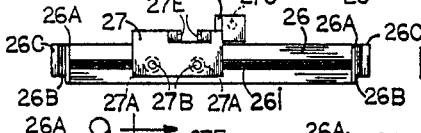
FIG1C
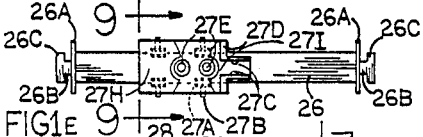
FIG1D
FIG1E
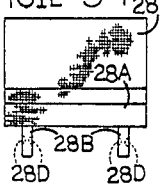
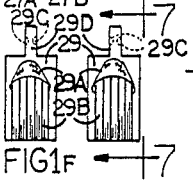
FIG1F
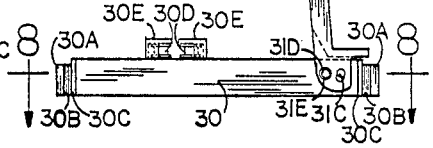
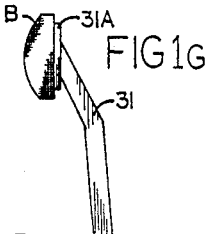
FIG1G

MULTIPLE PURPOSE EXERCISE DEVICE

BACKGROUND

1. Field of Invention:

This invention relates to multiple purpose exercise equipment which is as powerful and versatile as health spa and other heavy duty home exercise equipment but is completely portable and will give the user a complete workout including anaerobic as well as aerobic exercises.

2. Description of Prior Art

In our health conscious world, people have discovered that a regular routine of exercise plus a properly balanced diet can greatly enhance a person's physical as well as mental state of health. This discovery is especially important for the business executive/salesmann who basically live a sedentary and "out of the suitcase" type lifestyle. This new breed of individuals, for the most part, tend to favor exercising at the numerous health spas available on today's maket. While the health spas provide a good variety of machines for anaerobic as well as aerobic workouts this type of equipment tends to be extremely heavy and immobile as shown in U.S. Pat. No. 4,541,628 Parviainen Sep. 17, 1985. So it would seem that health spas are fine for those individuals who stay in the same area or can locate one while away from home. However, realistically most people who travel for a living cannot maintain a routine of exercise simply due to logistics reasons.

The other major area for health conscious individuals to find the means for staying in shape is home exercise equipment. As with the health spas there is a large number of home exercise equipment machines available. The exercise units that provide similar ranges of exercises to those found in health spa's still tend to be very bulky, heavy machines. This type of equipment can be found in U.S. Pat. Nos. 4,072,309 Wilson Feb. 7, 1978, 4,541,627 MacLean Sep. 17, 1985 and 4,023,795 Pauls May. 17, 1977. Due to these limitations, as previously stated with the health spas, it is not an effective solution for those individuals who travel for their living to maintain an exercise routine. From this demand came a variety of portable exercise units. However, they do not provide the variety and strength that health spa and heavy duty home exercise machines offer. The following U.S. Pat. Nos. show this style of portable exercise equipment 4,059,265 Wieder Nov. 22, 1977, 3,677,543 Richardson Jul. 18, 1972, 4,371,162 Hartzell Feb. 1, 1983 and 3,636,946 Hardy Jan. 25, 1972. Thus, the ever increasing market of traveling business executives/-saleamen require a product to satisfy this very large need.

To overcome these limitations described above, the following invention presented substantially fulfills this need.

OBJECTS AND ADVANTAGES

Accordingly I claim the following as my objects and advantages of the invention: to provide an exercise machine that has all of the advantages of the prior art exercising devices and none of the disadvantages, to provide such an exercise machine that is efficient, sturdy in construction and offers a wide variety of anaerobic and aerobic exercises, to provide such an exercise machine that is quick and easy to adjust from exercise to exercise, and to provide such an exercise machine that is compact for easy storage and completely portable.

Further objects and advantages of my invention will become apparent from a consideration of the drawings and ensuing description thereof.

DRAWING FIGURES

FIG. 1A shows a perspective view of the lever arm and the base unit with the biasing cord in position for exercise.

FIG. 1B shows a top view of the framework apparatus portion of the invention.

FIG. 1C shows a side view of the rail unit apparatus portion of the invention.

FIG. 1D shows a top view of the rail unit apparatus portion of the invention.

FIG. 1E shows a top view of the seat apparatus portion of the invention.

FIG. 1F shows a top view of the foot pedal apparatus portion of the invention.

FIG. 1G is a side view of the support stand apparatus portion of the invention.

Figure 7A:
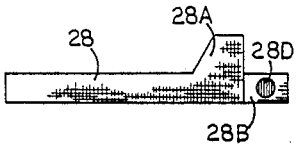
Figure 7B:
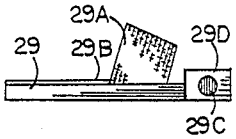

FIG. 7A–B shows a side view taken as on line 7—7 of FIG. 1.

Figure 8:
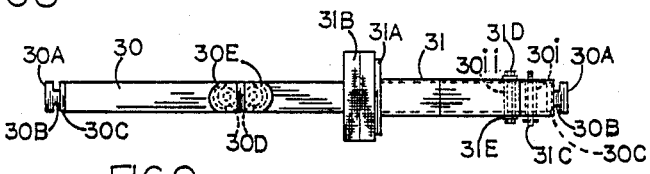

FIG. 8 shows a top view taken as on line 8—8 of FIG. 1.

Figure 9:
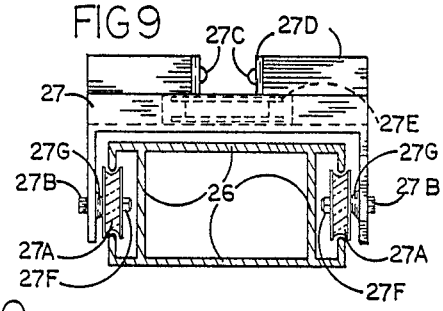

FIG. 9 shows an end view taken as on line 9—9 of FIG. 1.

Figure 10:
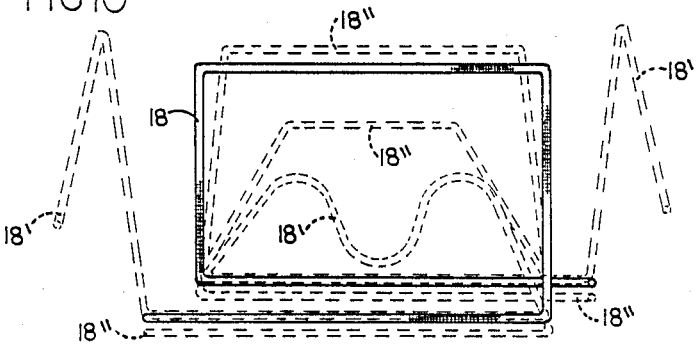

FIG. 10 shows a perspective view of the biasing cord in the various positions the cord can be found in while in use with the apparatus of the invention.

Figure 11:
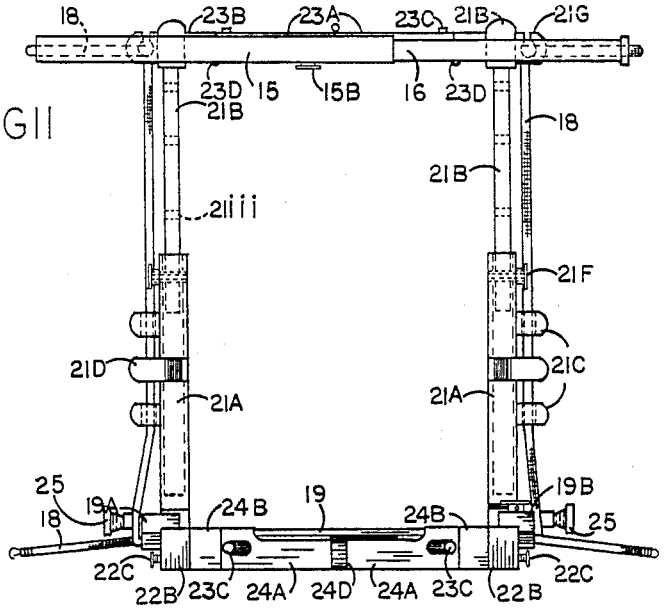

FIG. 11 shows a front view of the framework apparatus portion of the invention in an upright extended position with the base unit, lever arm and biasing cord secured into position.

Figure 12:
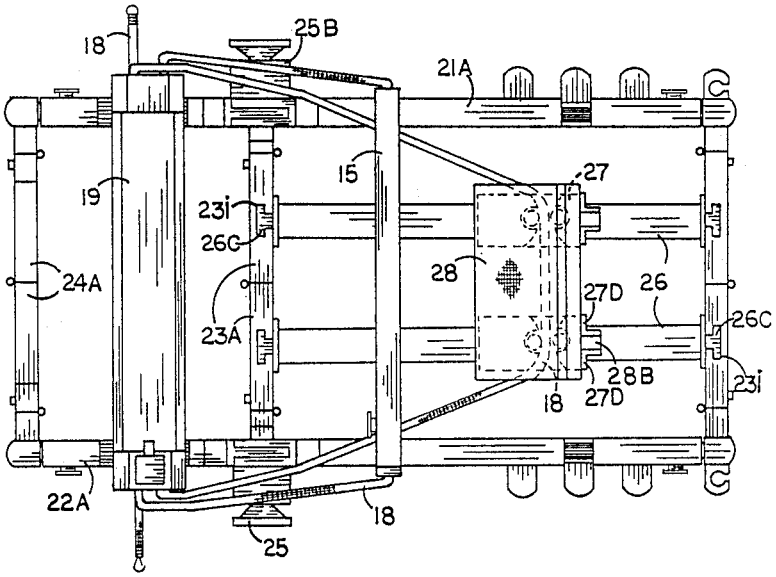

FIG. 12 shows a top view of the rowing apparatus portion of the invention.

Figure 13:
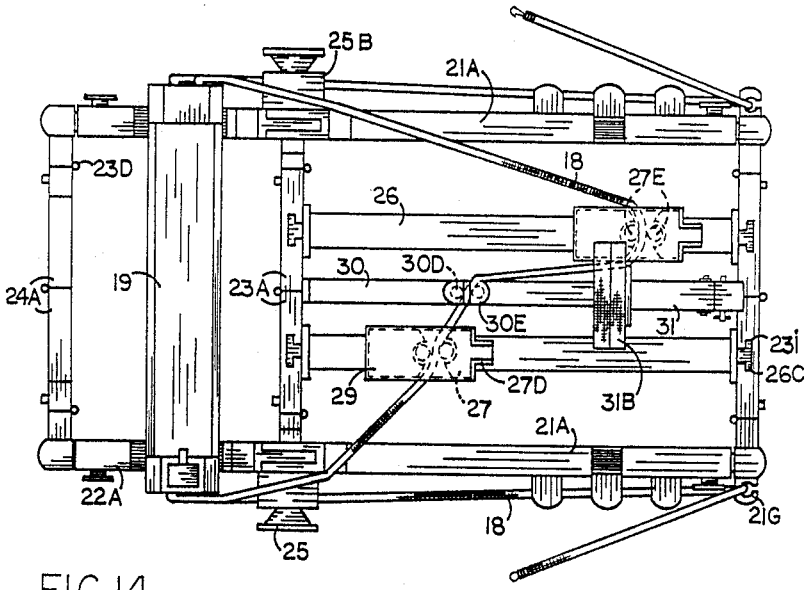

FIG. 13 shows a top view of the cross country ski apparatus portion of the invention.

Figure 14:
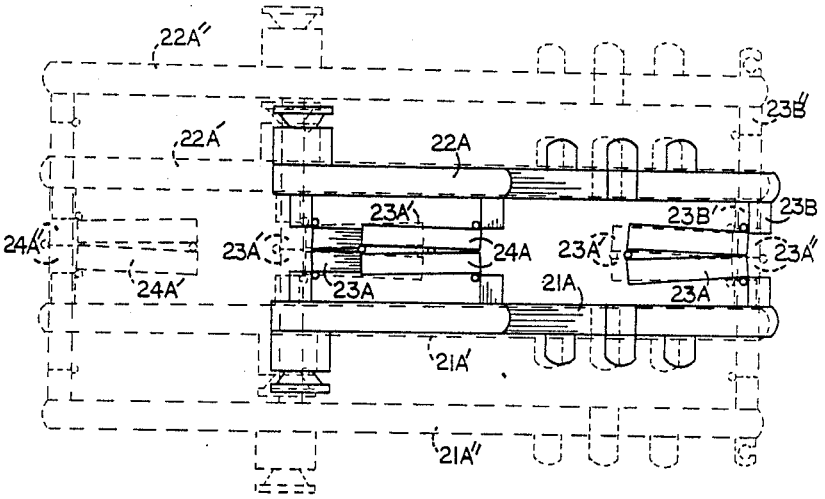

FIG. 14 shows a top view of the various positions the framework apparatus portion of the invention can be collapsed into.

DESCRIPTION OF INVENTION

Figure 2:
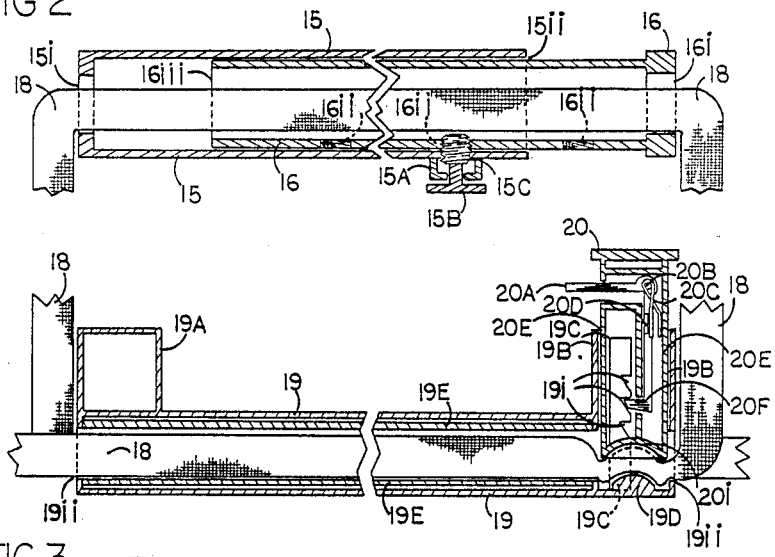
FIG. 2 shows a sectional view taken as on line 2—2 of FIG. 1.
Figure 3:
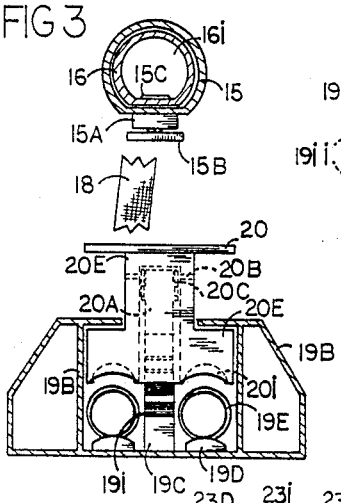
FIG. 3 shows an end view taken as on line 3—3 of FIG. 1.
Figure 4:
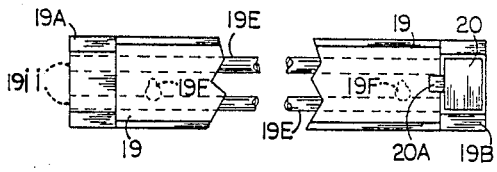
FIG. 4 shows a top view taken as on line 4—4 of FIG. 1.

Referring to FIG. 1, shows a multiple purpose exercise device consisting of a base unit, a telescopic lever arm, a biasing cord, a framework, a pair of gliding rail units, a support arm rail unit, a pair of foot pedal units and a seat unit according to the preferred embodiment of the invention. The base unit comprises a hollow, foot pedestal 19 supported by two enclosure caps 19A, 19B where end cap 19B houses locking device 20D as shown in FIGS. 1, 2 3 and 4. Located within pedestal 19 is a pair of hollow tubes 19E which are aligned with openings 19ii on end caps 19A and 19B best shown in FIGS. 2 and 4. As shown in FIGS. 2 and 3, locking device 20 comprises a locking bar 20E with concave openings 20i, a locking latch 20A positioned within locking bar 20E being pivotally attached by pin 20B, a spring 20C positioned on pin 20B being pinched in between extension edge 20D and the inner surface of locking bar 20E with the entire locking device 20 positioned over locking post 19C and knobs 19D. Openings 19ii and tubes 19E allow biasing cord 18 to pass thru the base unit in a looped manner as shown as 18 in FIG. 10.

The telescopic lever arm as displayed in FIGS. 1 and 2 comprises a hollow outer tube 15 having opening 15ii allowing hollow inner tube 16 to be slidingly received within tube 15 and a locking screw assembly 15A, 15B, 15C attached to the outer surface of tube 15. Openings 16ii allow locking screw bolt 15C enclosed within 15A to secure inner tube 16 at various lengths in respect to outer tube 15. Together, openings 15i, 15ii, 16i and 16iii allow biasing cord 18 to pass thru the telescopic lever arm.

Biasing cord 18 consists of an elongated, elastomeric shock absorber cord widely available from any shock cord manufacturer, like Thomas Taylor and Sons, Inc. located in Hudson, Mass. This biasing cord will be used as the resistance thru out all exercises employed by the invention. Attached to the ends of biasing cord 18 are hooks 18A, 18B shown in FIG. 1. The hooks are used to clip onto other biasing cords to allow changing from one biasing cord to another in a quick and efficient manner.

Figure 5:
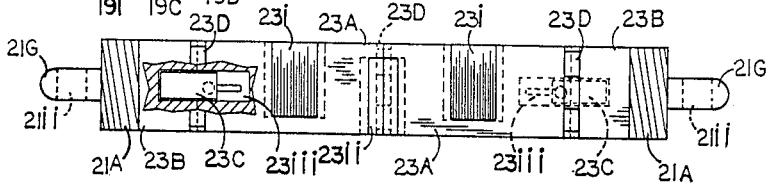
FIG. 5 shows an end view taken as on line 5—5 of FIG. 1.
Figure 6:
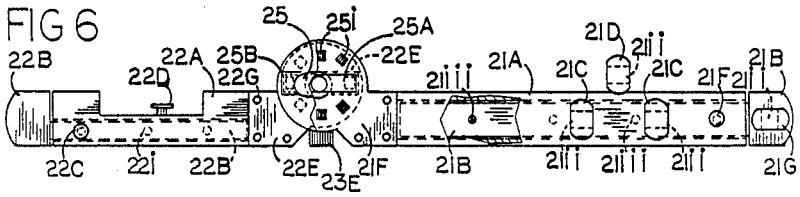
FIG. 6 shows a side view taken as on line 6—6 of FIG. 1.

The framework portion of the invention best shown in FIGS. 1, 5, and 6 comprises four hollow, rectangular shaped side members 21A, 22A connected by rotatable locking hinge 22E, 21H, 25, 25A, 25B which are supported by three collapsible stabilizer support units 23A, 23B, 23E, 24A,, 24B each connected by hinges 23D, 24D while end struts 23B, 24B, 23E are secured to extension units 21B, 22B, 21H, respectively. As shown in FIG. 6, side members 21A, 22A allow extension units 21B, 22B to be slidingly received thereof, while being secured at various lengths by inserting locking pins 21F, 22C thru openings 21iii and 22i. Attached to side members 21A, 22A, and extension units 21B are oval shaped guide posts 21C, 21D, 21G which allow biasing cord 18 to past thru openings 21i, 21ii within the posts keeping the cord properly positioned during exercise.

The rotatable locking hinge as discussed above is comprised of a male hinge extension 22E inserted into the gap of female hinge extension 21H both rotatably attached by an oval shaped extension axis (not shown) on the outer surface of end strut 22E allowing extensions 22E, 21H to rotate freely within a vertical plane best shown in FIGS. 1 and 6. Attached to the outer surface of female hinge extension 21H is enclosure 25B which houses locking prong 25A. Referring to FIG. 6, each extension hinge unit 22E, 21H has various openings 25i positioned in a circular manner. When openings 25i on both hinge units 22E, 21H are aligned locking prong 25A is then inserted thru the openings thus securing side members 21A, 22A in a locked position as shown in FIGS. 1, 11, 12, and 13.

The collapsible stabilizer support units 23A, 23B, 23E, 24A, 24B can be secured in a rigid position as shown in FIG. 5 by employing locking latches 23C enclosed in chambers 23iii. Locking latch 23C can be slid from chamber 23iii within stabilizer struts 23A, 24A into the chamber 23iii within end struts 23B, 23E,, 24B while still being within stabilizer struts 23A, 24A thus preventing the stabilizer struts from collapsing. This portion of the invention can best be shown in FIGS. 5 and 14.

The gliding rail units as shown in FIGS. 1, 9, 12, 13 used for the aerobic portion of the invention are comprised of an elongated, rectangular in shape tubular rail unit 26 each having a gliding track opening 26i along the left and right sides thereof, with a restraining edge 26A, a channel guide 26B, an attachment end 26C being secured to both the forward and rear ward ends of rail units 26. Additionally, a gliding unit 27 is attached to rail unit 26 by wheels 27A being positioned on the gliding track opening 26i thus allowing gliding unit 27 to roll freely to and fro on rail unit 26 as shown in FIG. 9. Gliding unit 27 is further comprised of a front and back plate 27H, 27I being secured to the upper surface of gliding unit 27 forming a gap allowing biasing cord 18 to past thru, a pair of rollers 27E being rotatably attached to the upper surface of gliding unit 27 within the semi-oval shaped openings on plates 27H, 27I, a pair of restraining walls 27D perpendicularly attached to the upper surface of plate 27I while being spaced apart to form a gap where within the gap locking coupling 27C is positioned. The gliding unit 27 is fully supported by wheels 27A which are secured to gliding unit 27 via bolt 27B being inserted thru an opening (not shown) on neck 27G and tighten in position by nut 27F shown in FIG. 9. As shown in FIGS. 12 and 13, rails units 26 are properly positioned for the aerobic exercise portions of the invention by inserting channel guide 26B and attachment end 26C into openings 23i found on stabilizer struts 23A while the framework unit would be positioned in a flat, horizontal position.

The foot pedal units as shown in FIGS. 1 and 7 are used to support and restrain the users feet while performing the cross country ski motion as displayed in FIG. 13. The foot pedals are comprised of a flat, rectangular shaped pedal 29 having a semi-oval shaped restraining collar 29A perpendicularly attached to the upper surface of pedal 29, a foot pad 29B secured also to the upper surface of pedal 29 to prevent the users foot from slipping during exercise, and an arm 29D extending outward from the front end of pedal 29 with concaved openings 29C positioned on opposite sides of arm 29D. As shown in FIG. 13, foot pedals 29 are placed and secured on the upper surface of gliding unit 27 by arm 29D being inserted into the gap formed by restraining walls 27D while being locked into position when locking coupling 27C fits snugly into openings 29C.

The seat unit as displayed in FIGS. 1 and 7 will be used with the rowing exercise portion of the invention. The seat is comprised of a square shaped seat 28 with a perpendicularly attached ridge 28A secured on the rear ward end of the upper surface of seat 28, and a pair of arms 28B extending outward from the rear ward end of seat 28 having concaved openings 28D found on opposite sides of arms 28B. As shown in FIG. 12, seat unit 28 is placed and secured on top of both gliding units 27 arms 28B being inserted into the gap formed by restraining wall 27D while being locked into position when locking coupling 27C fits snugly into openings 28D.

The support arm rail unit as shown in FIGS. 1 and 8 is used for supporting and restraining the users mid section while performing the cross country ski exercise portion of the invention. The support arm rail unit is comprised of an elongated, rectangular in shape rail 30 with a restraining edge 30C, a channel guide 30B and an attachment end 30A being secured to both the forward and rear ward ends of rail 30, a pair of rollers 30D attached rotatably to the upper edge of rail 30 being positioned far enough apart to form a gap allowing biasing cord 18 to be inserted, a pair of enclosures 30E also secured to the upper edge of rail 30 to house rollers 30D, and a support arm 31 being rotatably attached to rail 30 by insertion of bolt 31D thru opening 30ii and washers 31E. Support arm 31 is further comprised of a backing 31A being attached with its backside to the forward end of arm 31 with cushion pad 31B secured to the front side of backing 31A. Furthermore, support arm 31 can be secured in an upright position as shown in FIG. 1 by inserting locking pin 31C thru an opening (not shown) located on the rear ward end of arm 31 and thru chamber 31i on rail 30.

OPERATION OF INVENTION

The multiple purpose exercise device of FIG. 1 will perform a wide variety of anaerobic as well as aerobic exercises in which anyone skilled in the art will find superior to those shown in prior art inventions. To use the base unit 19 with the telescopic lever arm 15, 16, the user will need to first insert one end of biasing cord 18 thru one of the openings 19ii on the right end of base unit 19 passing thru hollow tube 19E out the left end of the base unit then inserting the same end of the biasing cord thru opening 15i on the left end of tube 15 passing thru hollow inner tube 16 out the right end of tube 16 then inserting the same end of the biasing cord into the other opening 19ii on the right end of the base unit passing thru the other hollow tube 19E out the left end of base unit 19 forming a loop as shown in FIGS. 1, 2, 3, and 10. To secure the biasing cord in the looped shape the user simply depresses locking device 20 down on the biasing cord pressing it against knobs 19D and into openings 20i until extension arm 20F of locking latch 20A snugly fits into one of the various notches 19i found on locking post 19C preventing the biasing cord from movement during exercise as shown in FIG. 2. The user then only has to stand on top of platform 19 while grasping the telescopic lever arm 15, 16 in any of a variety of over and under hand grip styles allowing the lever arm to be curled in an up and down manner while the biasing cord consistently and evenly applies resistance throughout the full range of motion. To use a different biasing cord 18 for changing resistance the user will simply attach the male hook 18A of a replacement biasing cord onto the female hook 18B of the currently used biasing cord while depressing locking latch 20A downward releasing locking device 20. This will allow the user to pull the currently used cord out of the looped shape while replacing it with the new replacement cord. The user then only has to detach the old biasing cord from the replacement cord then secure the new cord in position as previously described above.

The framework unit 21, 22, 23, 24, 25 of the invention as shown in FIG. 1 will be used in conjunction with base unit 19 and telescopic lever arm 15, 16 as well as with aerobic units 26, 28, 29, 30 to allow an even greater variety of exercises. Base unit 19 is attached to the framework by placing the bottom surface of the base unit onto the top edge of side members 22A while aligning the larger portion of opening 19F on top of locking post 22D then by simply pushing the base unit forward will allow the larger end of locking post 22D to pass thru the narrower opening of 19F thus securing the base unit to the framework apparatus. The telescopic lever arm is simply attached to the framework unit via the looped biasing cord being inserted into any of the openings 21ii, 21i on guideposts 21C, 21G and 21D respectively allowing the lever arm to straddle the top edge of side members 21A or extension unit 21B depending on what guide posts are being employed. In this position, the lever arm can be used to performed various leg and arm extension/curl exercises by simply setting up the framework unit in various 90 and 180 degree angled positions. As shown in FIG. 11, side members 21A can be secured in an upright 90 degree angle to side members 22A allowing the user to either stand or sit on the base unit while grasping the lever arm to perform various curling or pushing exercises as would be evident to those skilled in the art. The locking hinge device 22E, 21H, 25, 25A, 25B secured to the ends of side members 22A, 21A via bolts 22G as shown in FIG. 6 is the mechansim that secures the framework unit in the various 90 and 180 degree angled positions as discussed above. As shown in FIGS. 1 and 6 locking prong 25A, housed within enclosure 25B, can be slid into openings 25i found on both male and female hinge extensions 22E, 21H respectively when properly aligned. Openings 25i are found encircling the oval extension portion of male hinge 22E where the oval extension on female hinge 21H has only two openings 25i located on opposing sides with both series of openings being aligned within the same axis. This allows locking prong 25A to be inserted thru the hinges at different positions depending on the angle in which male hinge 22E is in relative to female hinge 21H.

The rowing portion of the invention as shown in FIG. 12 uses the framework unit, the base unit, the telescopic lever arm, the biasing cord, the rail units 26, and the seat 28. To use the rowing portion of the invention the framework unit should be secured in a 180 degree angle laying flat to the ground while having the base unit secured properly to the framework as previously described. The rail units 26 should then be placed into position by inserting attachment ends 26C flush into openings 23i found on middle struts 23A. The biasing cord as previously described will have to be looped into position with the base unit and the lever arm but prior to being secured the biasing cord will need a second loop created as shown as 18" in FIG. 10 being placed into the gap on the upper surface of both gliding units 27 resting against rollers 27E the biasing cord can then be secured by locking device 20. Seat unit 28 is then properly positioned on top of both gliding units 27 and secured once locking coupling 27C fits snugly into openings 28D thus keeping the biasing cord properly positioned during the rowing exercise. To perform the rowing exercise the user will simply sit on seat 28 facing towards the base unit while grasping lever arm 15, 16 and positioning his or her feet against end struts 23E. The actual motion, as clearly evident to those skilled in the art, is for the user to simply push back using his feet thus moving the gliding units along rail 26 until his legs are at full extension he would then pull the lever arm back towards his waist. To return back to the starting position, the user would relax the muscle tension applied thus allowing the tension of the biasing cord to return the user back to the starting position so the motion could then be repeated.

The cross country skiing portion of the invention as shown in FIG. 13 uses the same setup as described above for the rowing exercise except rail assembly 30 and foot pedals 29 are employed instead of telescopic lever arm 15, 16 and seat 28. To use the cross country skiing portion of the invention as with the rowing portion the framework unit 21, 22, 23, 24, 25 will have to be secured in the 180 degree angle layin flat to the ground with the base unit 19 being secured to the framework then rail assembly 30 has to be secured into position by inserting attachment ends 30A flush into openings 23ii. Support arm 31 connected to rail assembly 30 should be secured in the upright position as shown in FIG. 1 by using locking pin 31C. The biasing cord 18 should be looped thru the base unit but instead of using lever arm 15, 16 the cord should be inserted into the gap on the upper surface of one of the gliding units 27 then thru the gap formed between rollers 30D on rail assembly 30 thru the gap on the upper surface of the other gliding unit 27 then back thru base unit 19 and secured into place by locking device 20. The free ends of biasing cord 18 should then be inserted thru opening 21ii within guide posts 21G. The position of the biasing cord as described above is best shown as 18' in FIG. 10. Foot pedals 29 are then properly positioned on top of both gliding units 27 and secured once locking coupling 27C fits snugly into openings 29C thus keeping biasing cord 18 properly positioned during the cross country skiing exercise. To perform the cross country skiing exercise the user, facing towards support arm 31, will simply stand on top of each foot pedal 29 inserting his feet into each restraining collar 29A while pressing his mid-section against cushion pad 31B and grasping the free ends of biasing cord 18. The actual motion, as clearly evident to those skilled in the art is for the user to simply move one foot forward extending the biasing cord where this action will force the other foot backwards due to the tensioning of the biasing cord. The user would then move the backward placed foot forward which causes the forward placed foot backwards thus simulating the cross country leg motion. The cross country arm motion is accomplished when the user pulls back on the free end of the biasing cord in timing with the leg motion. In other words, when the right foot moves forward the left arm pulls back and vice versa with the left foot and right arm.

Referring to FIG. 14, the framework unit 21, 22, 23, 24, 25 can be collapsed for ease of storage and portability. The mechansims allowing this are hinges 24D, 23D and stabilizer struts 23A, 23B, 23E, 24A, 224B being segmented into separate units instead of one complete part. To collapse the framework, the user only has to pull back locking latches 23C back into struts 23A, 24A then by pushing inward on the mid-section of each stabilizer strut the framework thus collapses to position 22A', 23A', 24A', 21A' as shown in FIG. 14. The framework unit can be further collapsed by simply pulling back on handle 25 releasing locking prong 25A from its locked position and by pushing the rear ward portion 22A, 24A over on top of the forward portion 21A, 23A as shown as position 21A, 22A, 23A, 24A in FIG. 14. With the framework in this collapsed position along with the other units of the invention shown in FIG. 1 a travel bag could be designed to hold all these units thus allowing the user to carry the invention wherever her travels may take her thus maintaining a regular routine of exercise. Thus the reader will see that the exercise machine of the invention provides a highly efficient, durable, yet totally portable exercise machine which can be used by persons of almost any age.

While my above description contains many specificities, these should not be construed as limitations on the scope of the invention, but rather as an exemplification of one preferred embodiment thereof. Many other variations are possible. For example, the locking device within the base unit could be any type of fastening means as long as it could properly secure varying thicknesses of a biasing cord. Any suitable material ranging from high impact plastic to a chromium alloy could be used to build the base unit, lever arm, framework and the aerobic units as long as it is durable, strong and lightweight to allow ease of portability. Any type of biasing means, such as elastic bands or straps, could be employed instead of the stock absorber cord. Accordingly, the scope of the invention should be determined not by the embodiment(s) illustrated, but by the appended claims and their legal equivalents.

APPENDIX I

Drawing Reference Numerals

15 outer tube
15A enclosure for 15C and 15B
15B adjustment knob for 15C
15C locking screw bolt
15i opening in 15 for 18
15ii opening in 15 for 18 and 16
16 inner tube
16i opening in 16 for 18
16ii threaded screw openings for 15C
16iii opening in 16 for 18
18 biasing cord
18A male hook
18B female hook
19 foot pedestal
19A enclosure cap on 19
19B enclosure cap on 19 and for 20
19C locking post
19D knobs on 19B for 18
19E hollow tubes within 19 for 18
19F opening on 19 for 22D
19i notches on 19C for 20F
19ii openings on 19A and 19B for 18
20 locking device within 19B for 18
20a locking latch within 20
20B pin supporting 20A
20C spring on 20B for 20A
20D extension edge on 20A for 20C
20E locking bar of 20
20F extension arm on 20A for 19i
20i recessed section on 20 for 18
21A hollow side member
21B extension unit within 21A
21C guide post on 21A for 18
21D guide post on 21A for 18
21F locking pin on 21A for 21B
21G guide post on 21B for 18
21H female hinge extension on 21A for 22E
21i opening on 21D for 18
21ii openings on 21G and 21C for 18
21iii openings on 21B for 21F
22A hollow side member
22B extension unit within 22A
22C locking pin on 22A for 22i
22D locking post on 22A for 19F
22E male hinge extension on 22A for 21H
22G bolts for 22E and 21H
22i openings on 22B for 22C
23A middle struts
23B end struts
23C locking latch in 23A and 24A
23D hinge for 23B, 23A, 23E, 24B and 24A
23E end struts
23i opening on 23A for 26C and 26B

23ii opening on 23A for 30A and 30B
23iii enclosed chamber on 23A, 23B, 23E, 24A and 24B for 23C
24A middle struts
24B end struts
24D hinge on 24A
25 handle on 25A
25A locking prong within 25B for 22E and 21H
25B enclosure on 21H for 25A
25i openings on 23E and 21H for 25A
26 rail units
26A restraining edge on 26
26B channel guide on 26 for 23i
26C attachment end on 26 for 23i
26i gliding track opening on 26 for 27A
27 gliding unit
27A wheels on 27 for 26
27B bolt on 27 for 27A
27C locking coupling for 28D and 29D
27D restraining wall on 27I for 28 and 29
27E rollers on 27 for 18
27F nuts on 27B for 27A
27G neck on 27 for 27A
27H back plate on 27 for 27E, 28 and 29
27I front plate on 27 for 27E, 28 and 29
28 seat
28A ridge on 28
28B extended arm on 28 for 27
28D openings on 28B for 27C
29 foot pedal
29A restraining collar on 29
29B foot pad on 29
29C opening on 29D for 27C
29D extended arm on 29 for 27
30 rail
30A attachment end on 30 for 23ii
30B channel guide on 30 for 23ii
30C restraining edge on 30
30D rollers on 30 for 18
30E enclosure on 30 for 30D
30i chamber for 31C
30ii chamber for 31D
31 support arm on 30
31A backing on 31 for 31B
31B cushioned pad on 31A
31C locking pin for 30 and 31
31D bolt on 30 and 31
31E washer for 31D

I claim:

1. A portable multipurpose exercise apparatus comprises:

a portable lever arm having telescoping means with openings on the forward and rearward ends with a biasing means therethrough, and lever arm locking means for securing said lever arm at varying extended lengths, a portable platform base having an upper surface allowing a user to stand on during various aerobic exercise programs, and to sit on during other various aerobic exercise programs, a lower surface which engages the ground, wherein the upper surface is supported horizontally above the lower surface by a plurality of downwardly extending side walls with openings on both the forward and rearward ends, and platform base locking means for securing said biasing means at various positions, a portable framework having two framework sides, each of said framework sides having a forward side member and a rearward side member rotatably attached to each other and allowing said framework forward and rearward side members to be positioned in various angles in respect to each other within a vertical plane, a plurality of stabilizer means secured to the inner walls of said framework forward and rearward side members to support said framework forward and rearward side members in a perpendicular position in respect to the ground, and framework attachment means for receiving the platform base, a plurality of portable rail units, each of said rail units having an elongated, generally rectangular shaped tubular rail member with a longitudinal channel on two opposite sides of said rail member, rail member fastening means on both the forward and rearward ends of said rail member to secure said rail member to the framework, and a gliding unit having a plurality of rollers for fully supporting and allowing movement of said guiding unit on said longitudinal channels, an upper surface gliding member having a recessed area forming a channel, a plurality of vertically positioned gliding side members attached perpendicularly to said upper surface gliding member, and a plurality of roller units perpendicularly attached to said gliding side members for guiding said biasing means therethrough to form a loop configurations for providing resistance to the portable multipurpose exercise apparatus, a seat unit comprising a horizontal seat surface for supporting said user in a sitting position, and seat securing means for securing said seat unit to said gliding units during a rowing exercise program and said various aerobic exercise programs, a plurality of foot pedals, each of said foot pedals having a horizontal foot pedal surface for supporting the user's foot, and foot pedal securing means for securing said foot pedal to said gliding unit, and a support stand having a support stand rail member with support stand fastening means on the forward and rearward ends thereof to secure said support stand rail member to the framework, and a support member rotatably attached to said support stand rail member for restraining the user's forward motion during a cross country skiing exercise program and said various aerobic exercise programs, wherein said seat unit, said plurality of foot pedals, and said support stand are interchangeable for the desired exercise program.

2. The apparatus of claim 1 wherein the biasing means is an elongated elastomeric cable.

3. The apparatus of claim 2 wherein said telescoping means comprises a pair of elongated handles, wherein the diameter of one of said handles allows the other of said handles to be slidingly received thereof for allowing the user to position said handle at different lengths, wherein each of said elongated handles is a hollow tube whereby allowing said biasing means to transversely through said elongated handles, wherein said platform base further comprises a plurality of hollow tubular base members within said platform base with the ends of said tubular base members being axially aligned to the openings on said forward and rearward ends of said platform base, whereby allowing said biasing means to transversely through said tubular base members, and wherein said plurality of stabilizer means comprise a forward stabilizer member, a middle stabilizer member and a rearward stabilizer member attached to the inner walls of said framework forward and rearward side members, said forward and middle stabilizer members having stabilizer attachment means for receiving and securing said rail units, wherein said support stand further comprises a hinge device for rotatably attached said support member to said support stand rail member, a support locking unit associated with said support member and said support stand rail member for securing said support member in an upright position in respect to said support stand rail member, and a guide unit comprising a channel allowing the biasing means to transversely through said guide unit, and wherein said biasing means positioned in a plurality of loop configurations for performing different type of said exercise programs, wherein said plurality of loop configurations comprises a first loop configuration, said first loop configuration inserts said biasing means through one of the hollow tubular base members, said elongated handles and the other of said hollow tubular members, wherein said platform base locking means engaged to secure said biasing member in the first loop configuration for performing one of said various aerobic exercise programs, whereby said user stands upon the platform base while grasping the lever arm to perform various push and pull exercises.

4. The apparatus of claim 3 wherein the framework further comprises the guide posts located on one of said framework sides for allowing the lever arm to rest freely on the top edge of said framework sides, wherein said plurality of loop configurations further comprises a second loop configuration, said second loop configuration inserts said biasing means through said elongated handles and said hollow tubular base members, and secured to said guide posts of said framework for performing the other of said various aerobic exercise programs, whereby a user sits upon the platform base while grasping the lever arm to perform various curling exercises.

5. The apparatus of claim 3 wherein said plurality of loop configurations further comprises a third loop configuration, wherein said third loop configuration inserts said biasing means through one of the hollow tubular members within the platform base, the channel on one of said upper surface gliding members of one of the gliding units positioned on one of the rail units while attaching one of the foot pedals onto said gliding unit, the guide unit positioned on the support stand rail member, the channel on the other of said upper surface gliding members of the other gliding unit positioned on the other rail unit while attaching the other foot pedal onto said other gliding unit, and the other hollow tubular member within the platform base, wherein said platform base locking means engaged to secure said biasing means in the third looped configuration, whereby said user moves said foot pedals on said gliding units to and fro on the rail units for performing said cross country skiing exercise program.

6. The apparatus of claim 3 wherein said plurality of loop configurations further comprises a fourth loop configuration, wherein said fourth loop configuration inserts said biasing means through one of the hollow tubular members within the platform base, the channel on one of said upper surface gliding members of one of the gliding units positioned on one of the rail units, the channel on the other of said upper surface gliding members of the other gliding unit positioned on the other rail unit while attaching the seat unit onto both said gliding units, the other hollow tubular member within the platform base, said elongated handles, and said one of the hollow tubular members within the platform base, wherein said platform base locking means engaged to secure said biasing member in the fourth loop configuration for performing said rowing exercise programs, whereby said user sits upon the seat while engaged their feet against the middle stabilizer member of the framework at the same time grasping the lever arm so that said user moves said seat unit on said gliding units simultaneously by pushing said user's foot outwardly and pulling said lever arm inwardly toward said user.

7. The apparatus of claim 1 wherein the telescoping means comprises a pair of elongated handles, the diameter of one of said handles allows the other of said handles to be slidingly received thereof for allowing the user to position said handles at different lengths.

8. The apparatus of claim 7 wherein each of said elongated handles is a hollow tube whereby allowing the biasing means to transversely through said elongated handles.

9. The apparatus of claim 1 wherein the platform base further comprises a plurality of hollow tubular base members within said platform base with the ends of said tubular base members being axially aligned to the openings on the forward and rearward ends of said platform base, whereby allowing the biasing means to transversely through said tubular base members, and platform base attachment means adapted to said framework attachment means for securing said platform base to the framework, and wherein said platform base locking means comprises an adjustable locking bar allowing the user to engage said bar onto the biasing means positioned within said tubular base members whereby preventing movement of said biasing means during said exercise programs.

10. The apparatus of claim 9 wherein said platform base attachment means comprises a plurality of openings positioned on the lower surface of the platform base.

11. The apparatus of claim 1 wherein each of said plurality of stabilizer means comprises a forward stabilizer member, a middle stabilizer member and a rearward stabilizer member attached to the inner walls of said framework forward and rearward side members, wherein each of said stabilizer members comprises a plurality of struts rotatably attached with stabilizer locking means for securing said stabilizer members in a perpendicular angle in respect to said framework forward and rearward side members, and wherein said forward and middle stabilizer members having stabilizer attachment means for receiving and securing the rail units and the support stand.

12. The apparatus of claim 11 wherein said stabilizer attachment means comprises a plurality of couplings positioned on the inner walls of both the forward and middle stabilizer members.

13. The apparatus of claim 11 wherein the framework forward and rearward side members comprise a plurality of generally rectangular shaped framework hollow members with an opening on a first end thereof, and a plurality of generally rectangular shaped arms, wherein said arms are slidingly received within said framework hollow members through said first end opening of said framework hollow members for allowing the user to position said arms at different lengths with framework member locking means to secure said arms at said different lengths.

14. The apparatus of claim 13 wherein the platform base attachment means comprises a plurality of openings positioned on said lower surface of said platform base, and wherein said framework attachment means comprises a post for receiving the openings positioned on the lower surface of the platform base whereby allowing engagement of said platform base to the framework, a plurality of guide posts positioned on the outer walls of said framework forward and rearward side members allowing the biasing means to transversely through said posts and whereby keeping said biasing means properly aligned with respect to said framework forward and rearward side members during said various aerobic programs, and framework rotatable means for allowing said framework forward and rearward side members to be positioned in said various angles in respect to each other within a vertical plane.

15. The apparatus of claim 14 wherein said rotatable means comprises a plurality of fingers extending through the finger openings on the second end of said framework hollow members, wherein said finger openings on said framework forward side members and said finger openings on said framework rearward side members are being axially aligned with respect to each other and allowing a prong to be received through a pair of said axially aligned finger openings on said fingers whereby securing said framework forward and rearward side members in the position desired by the user, and wherein said fingers being supported by an oval axis extending from the forward and rearward ends of the middle stabilizer member.

16. The apparatus of claim 1 wherein said plurality of stabilizer means comprise a forward stabilizer member, a middle stabilizer member and a rearward stabilizer member attached to the inner walls of said framework forward and rearward side members, wherein said forward and middle stabilizer members having stabilizer attachment means for receiving and securing said rail units, wherein the rail member fastening means being adapted into the stabilizer attachment means of said forward and middle stabilizer members, each of said gliding units having a plurality of gliding fingers extending from the forward portion thereof, wherein said gliding fingers form a coupling for receiving and securing the seat unit and foot pedals, and said channel allows the biasing means to transverse to and fro through said channel during said exercise programs.

17. The apparatus of claim 1 wherein said gliding units further comprises a plurality of gliding fingers extending from the forward portion thereof, wherein said gliding fingers form a coupling for receiving and securing the seat unit and foot pedals, and wherein the seat unit comprises a retaining ridge positioned on the rearward end thereof whereby preventing the user from slippage when said user exhibits force against the seat unit during said rowing and said various aerobic exercise programs, and a plurality of seat fingers extending from the rearward portion of said seat unit, each of said seat fingers includes removably attachable means allowing said seat fingers to be received and secured into the coupling, whereby allowing engagement of said seat unit to the gliding units.

18. The apparatus of claim 1 wherein said gliding units further comprises a plurality of gliding fingers extending from the forward portion thereof, wherein said gliding fingers form a coupling for receiving and securing the seat unit and foot pedals, and wherein the foot pedals comprise a restraining element positioned on the forward end of said foot pedals for preventing slippage when said user exhibits force against the foot pedals during said cross country skiing exercise program, and a foot pedal finger extending from the forward end of said foot pedals, wherein said foot pedal finger includes removably attachable means allowing said foot pedal finger to be received and secured into the coupling, whereby allowing engagement of said foot pedals to the gliding units.

19. The apparatus of claim 1 wherein said plurality of stabilizer means comprise a forward stabilizer member, a middle stabilizer member and a rearward stabilizer member attached to the inner walls of said framework forward and rearward side members, wherein said forward and middle stabilizer members having stabilizer attachment means for receiving and securing said rail units, wherein the support stand further comprises a hinge device for rotatably attached said support member to said support stand rail member, a support stand locking unit associated with said support member and said support stand rail member for securing said support member in an upright position in respect to said support stand rail member, and a guide unit comprising a channel allowing the biasing means to transversely through said guide unit, whereby keeping said biasing means properly positioned in respect to said support stand rail member during said cross country skiing and said various aerobic exercise programs, wherein said support stand fastening means being adapted into the stabilizer attachment means of said forward and middle stabilizer members.

* * * * *